US011105288B1

(12) United States Patent
Yohannes et al.

(10) Patent No.: US 11,105,288 B1
(45) Date of Patent: Aug. 31, 2021

(54) ENGINE WARMUP ON PEDAL-START VEHICLE

(71) Applicant: Textron Inc., Providence, RI (US)

(72) Inventors: Zekarias W. Yohannes, Augusta, GA (US); Justin Williams, Warrenville, SC (US)

(73) Assignee: TEXTRON INNOVATIONS INC., Providence, RI (US)

( * ) Notice: Subject to any disclaimer, the term of this patent is extended or adjusted under 35 U.S.C. 154(b) by 0 days.

(21) Appl. No.: 17/002,906

(22) Filed: Aug. 26, 2020

(51) Int. Cl.
*F02D 41/06* (2006.01)
*F02D 41/24* (2006.01)
*F02D 41/00* (2006.01)

(52) U.S. Cl.
CPC ..... *F02D 41/064* (2013.01); *F02D 41/0002* (2013.01); *F02D 41/2422* (2013.01); *F02D 2200/021* (2013.01); *F02D 2200/101* (2013.01); *F02D 2200/602* (2013.01)

(58) Field of Classification Search
CPC ..... Y02T 10/40; Y02T 10/12; B60W 10/06; B60W 2510/0638; B60W 2540/10; F02D 41/064
See application file for complete search history.

(56) References Cited

U.S. PATENT DOCUMENTS

2009/0112448 A1* 4/2009 Kawamura ..... F02D 41/061 701/110
2017/0096953 A1* 4/2017 Yu ..... F02D 41/068
2017/0167416 A1* 6/2017 Baria ..... F02B 37/12
2017/0306893 A1* 10/2017 Leone ..... B60K 6/445
2019/0078478 A1* 3/2019 Martin ..... F02M 26/05

* cited by examiner

*Primary Examiner* — Sizo B Vilakazi
(74) *Attorney, Agent, or Firm* — Sandberg Phoenix and von Gontard, P.C.

(57) ABSTRACT

A method for cold engine starting in a pedal-start vehicle that comprises determining an ICE temperature value of an internal combustion engine of the vehicle upon starting the engine via depression of an accelerator, then comparing the ICE temperature value to a predetermined ICE temperature threshold value. Thereafter, when the ICE temperature value is below a predetermined ICE threshold value, controlling operation of the engine such that an RPM of the internal combustion engine remains within a predetermined idle RPM range for a predetermined amount of time, regardless of throttle control commands from the accelerator pedal of the vehicle, or when the ICE temperature value is equal to or greater than the predetermined ICE threshold value, or controlling operation of the internal combustion engine in accordance with the throttle control commands from the accelerator pedal.

14 Claims, 5 Drawing Sheets

TABLE 1

| TEMPERATURE (°C) | FORCED IDEL TIME (sec) |
|---|---|
| X | Y |
| -40 | 20 |
| -30 | 15 |
| -20 | 10 |
| -10 | 5 |
| 0 | 0 |
| 10 | 0 |
| 20 | 0 |
| 30 | 0 |
| 40 | 0 |
| 50 | 0 |
| 60 | 0 |
| 70 | 0 |
| 80 | 0 |
| 90 | 0 |
| 100 | 0 |
| 110 | 0 |
| 120 | 0 |

FIG. 4

TABLE 2

| ENGINE TEMP VS ENGINE RUN TIME | | CYLINDER HEAD TEMPERATURE | | | | | | | | | | | | | | | | |
|---|---|---|---|---|---|---|---|---|---|---|---|---|---|---|---|---|---|---|
| | | -40 | -30 | -20 | -10 | 0 | 10 | 20 | 30 | 40 | 50 | 60 | 70 | 80 | 90 | 100 | 110 | 120 |
| ENGINE RUN TIME (sec) | 5 | PEDAL UP IDLE | PEDAL UP IDLE | PEDAL UP IDLE | PEDAL UP IDLE | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 10 | PEDAL UP IDLE | PEDAL UP IDLE | PEDAL UP IDLE | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 15 | PEDAL UP IDLE | PEDAL UP IDLE | PEDAL UP IDLE | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 20 | PEDAL UP IDLE | PEDAL UP IDLE | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 25 | PEDAL UP IDLE | PEDAL UP IDLE | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 30 | PEDAL UP IDLE | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 35 | PEDAL UP IDLE | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 40 | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 45 | PEDAL UP IDLE | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 50 | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 55 | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |
| | 60 | PEDAL UP IDLE | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL | PEDAL UP STALL |

FIG. 5

ENGINE WARMUP ON PEDAL-START VEHICLE

FIELD

The present teachings relate to pedal-start internal combustion engine vehicle drive systems, and more particularly to pedal-start engine warm-up functionality during cold engine start situations.

BACKGROUND

The statements in this section merely provide background information related to the present disclosure and may not constitute prior art.

Traditionally, utility vehicles (e.g., golf cars) are designed not to idle with the pedal up and do not require a key switch to be turned to the "off" position to shut the engine down. Generally, the engine shuts off when the operator is not pressing the accelerator pedal, whereafter the engine is not allowed to idle and will remain shut off without accelerator pedal input. Internal combustion engine powered utility vehicles are typically designed such that the engine will start quickly and accelerate upon pressing the accelerator pedal, commonly referred to as pedal start. When operated under such parameters in an extremely cold environment, the engine may not be near a desired operating temperature when the operator depresses the accelerator pedal to start the engine and accelerate the vehicle. Quickly starting the engine and immediately accelerating in a cold environment may cause a cold engine to overconsume fuel and run rough or stall. For example, attempts to start the engine when cold and has not reached a desired operating temperature can wet-foul the spark plug(s), rendering the engine inoperable. Additionally, the issues can be compounded with pedal-start engines that have multiple cold start in a short span of time.

SUMMARY

Generally, the present disclosure provides a method for controlling the operation of a vehicle internal combustion engine (ICE), wherein at each startup execution of an ICE management algorithm will check the engine temperature via one or more sensor embedded on the ICE and, in certain scenarios, will command the engine to idle for a certain period of time based on a lookup table (an associative array of data) or map (or set of tables and/or maps) accessed via execution of the ICE management algorithm. Therefore, the ICE is allowed to warm up for a specific length of time in between accelerator pedal presses, and also will burn off any unburnt fuel, resulting in the reduction of spark plug wet-fouling that can be caused by repeated start and stop conditions. Additionally, upon a cold start of the ICE, the ICE management algorithm will command the ICE to idle and not allow ICE propelled movement of the vehicle for a pre-determined amount of time.

For example in various embodiments the present disclosure provides a method for cold engine starting in a pedal-start vehicle that comprises determining an ICE temperature value of an internal combustion engine of the vehicle upon starting the engine via depression of an accelerator, then comparing the ICE temperature value to a predetermined ICE temperature threshold value. Thereafter, when the ICE temperature value is below a predetermined ICE threshold value, controlling operation of the engine such that an RPM of the internal combustion engine remains within a predetermined idle RPM range for a predetermined amount of time, regardless of throttle control commands from the accelerator pedal of the vehicle, or when the ICE temperature value is equal to or greater than the predetermined ICE threshold value, or controlling operation of the internal combustion engine in accordance with the throttle control commands from the accelerator pedal.

This summary is provided merely for purposes of summarizing various example embodiments of the present disclosure so as to provide a basic understanding of various aspects of the teachings herein. Various embodiments, aspects, and advantages will become apparent from the following detailed description taken in conjunction with the accompanying drawings which illustrate, by way of example, the principles of the described embodiments. Accordingly, it should be understood that the description and specific examples set forth herein are intended for purposes of illustration only and are not intended to limit the scope of the present teachings.

DRAWINGS

The drawings described herein are for illustration purposes only and are not intended to limit the scope of the present teachings in any way.

FIG. 4 is an exemplary "Engine Temperature vs Forced Idle Time" table accessed during execution of the ICE management algorithm, in accordance with various embodiments of the present disclosure.

FIG. 5 is an exemplary "Engine Temperature vs Engine Run Time" table accessed during execution of the ICE management algorithm, in accordance with various embodiments of the present disclosure.

Corresponding reference numerals indicate corresponding parts throughout the several views of drawings.

DETAILED DESCRIPTION

Figure 1:
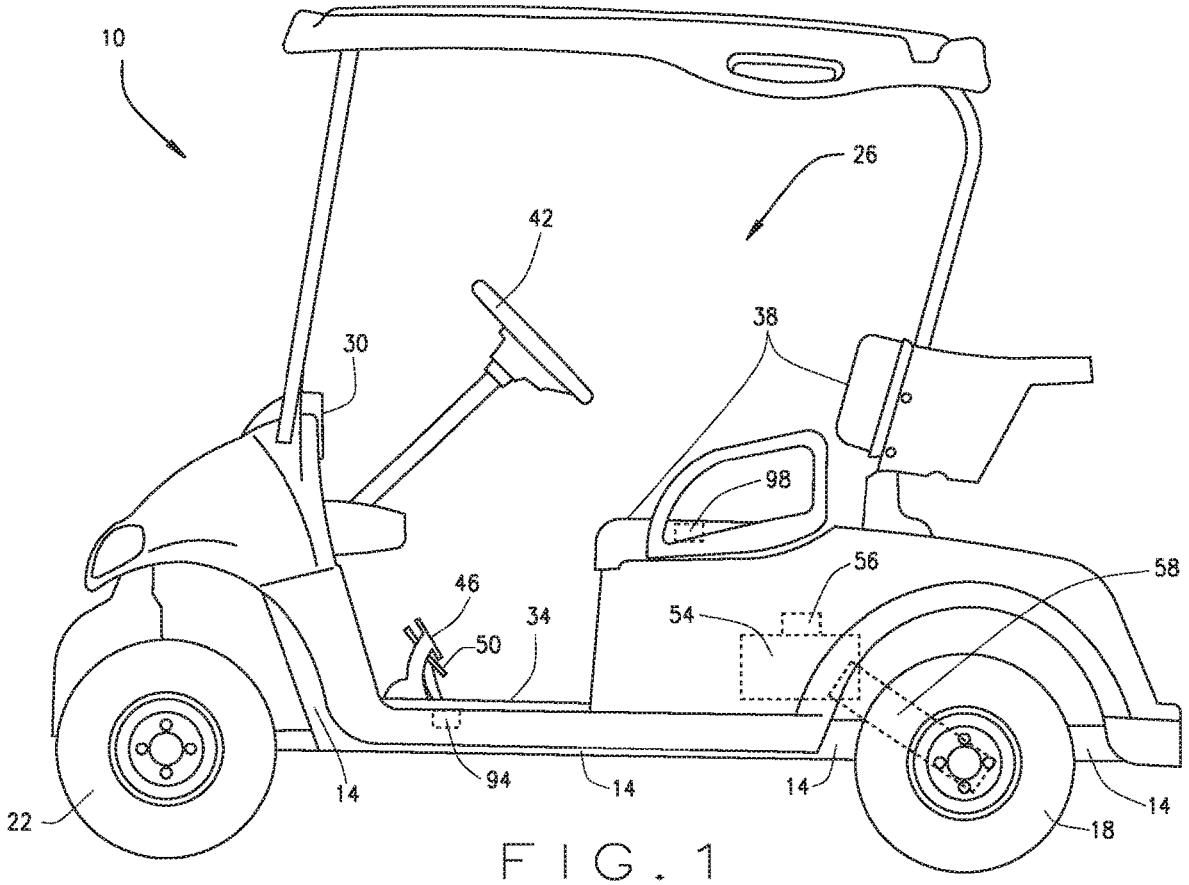
FIG. 1 is a side view of a gas-powered utility vehicle that is structured and operable to limit or restrict engine powered movement prior to the vehicle engine reaching a predetermined temperature, in accordance with various embodiments of the present disclosure.

The following description is merely exemplary in nature and is in no way intended to limit the present teachings, application, or uses. Throughout this specification, like reference numerals will be used to refer to like elements. Additionally, the embodiments disclosed below are not intended to be exhaustive or to limit the invention to the precise forms disclosed in the following detailed description. Rather, the embodiments are chosen and described so that others skilled in the art can utilize their teachings. As well, it should be understood that the drawings are intended to illustrate and plainly disclose presently envisioned embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

Unless otherwise defined, all technical and scientific terms used herein have the same meaning as commonly understood by one of ordinary skill in the art to which this disclosure belongs. The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises", "comprising", "including", and "having" are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps can be employed.

When an element, object, device, apparatus, component, region or section, etc., is referred to as being "on", "engaged to or with", "connected to or with", or "coupled to or with" another element, object, device, apparatus, component, region or section, etc., it can be directly on, engaged, connected or coupled to or with the other element, object, device, apparatus, component, region or section, etc., or intervening elements, objects, devices, apparatuses, components, regions or sections, etc., can be present. In contrast, when an element, object, device, apparatus, component, region or section, etc., is referred to as being "directly on", "directly engaged to", "directly connected to", or "directly coupled to" another element, object, device, apparatus, component, region or section, etc., there may be no intervening elements, objects, devices, apparatuses, components, regions or sections, etc., present. Other words used to describe the relationship between elements, objects, devices, apparatuses, components, regions or sections, etc., should be interpreted in a like fashion (e.g., "between" versus "directly between", "adjacent" versus "directly adjacent", etc.).

As used herein the phrase "operably connected to" will be understood to mean two are more elements, objects, devices, apparatuses, components, etc., that are directly or indirectly connected to each other in an operational and/or cooperative manner such that operation or function of at least one of the elements, objects, devices, apparatuses, components, etc., imparts are causes operation or function of at least one other of the elements, objects, devices, apparatuses, components, etc. Such imparting or causing of operation or function can be unilateral or bilateral.

As used herein, the term "and/or" includes any and all combinations of one or more of the associated listed items. For example, A and/or B includes A alone, or B alone, or both A and B.

Although the terms first, second, third, etc. can be used herein to describe various elements, objects, devices, apparatuses, components, regions or sections, etc., these elements, objects, devices, apparatuses, components, regions or sections, etc., should not be limited by these terms. These terms may be used only to distinguish one element, object, device, apparatus, component, region or section, etc., from another element, object, device, apparatus, component, region or section, etc., and do not necessarily imply a sequence or order unless clearly indicated by the context.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) taught herein, and because many modifications may be made in the embodiments described herein, it is to be understood that the details herein are to be interpreted as illustrative and non-limiting.

The apparatuses/systems and methods described herein can be implemented at least in part by one or more computer program products comprising one or more non-transitory, tangible, computer-readable mediums storing computer programs with instructions that may be performed by one or more processors. The computer programs may include processor executable instructions and/or instructions that may be translated or otherwise interpreted by a processor such that the processor may perform the instructions. The computer programs can also include stored data. Non-limiting examples of the non-transitory, tangible, computer readable medium are nonvolatile memory, magnetic storage, and optical storage.

As used herein, the term module can refer to, be part of, or include an application specific integrated circuit (ASIC); an electronic circuit; a combinational logic circuit; a field programmable gate array (FPGA); a processor (shared, dedicated, or group) that performs instructions included in code, including for example, execution of executable code instructions and/or interpretation/translation of uncompiled code; other suitable hardware components that provide the described functionality; or a combination of some or all of the above, such as in a system-on-chip. The term module can include memory (shared, dedicated, or group) that stores code executed by the processor.

The term code, as used herein, can include software, firmware, and/or microcode, and can refer to one or more programs, routines, functions, classes, and/or objects. The term shared, as used herein, means that some or all code from multiple modules can be executed using a single (shared) processor. In addition, some or all code from multiple modules can be stored by a single (shared) memory. The term group, as used above, means that some or all code from a single module can be executed using a group of processors. In addition, some or all code from a single module can be stored using a group of memories.

Figure 2:
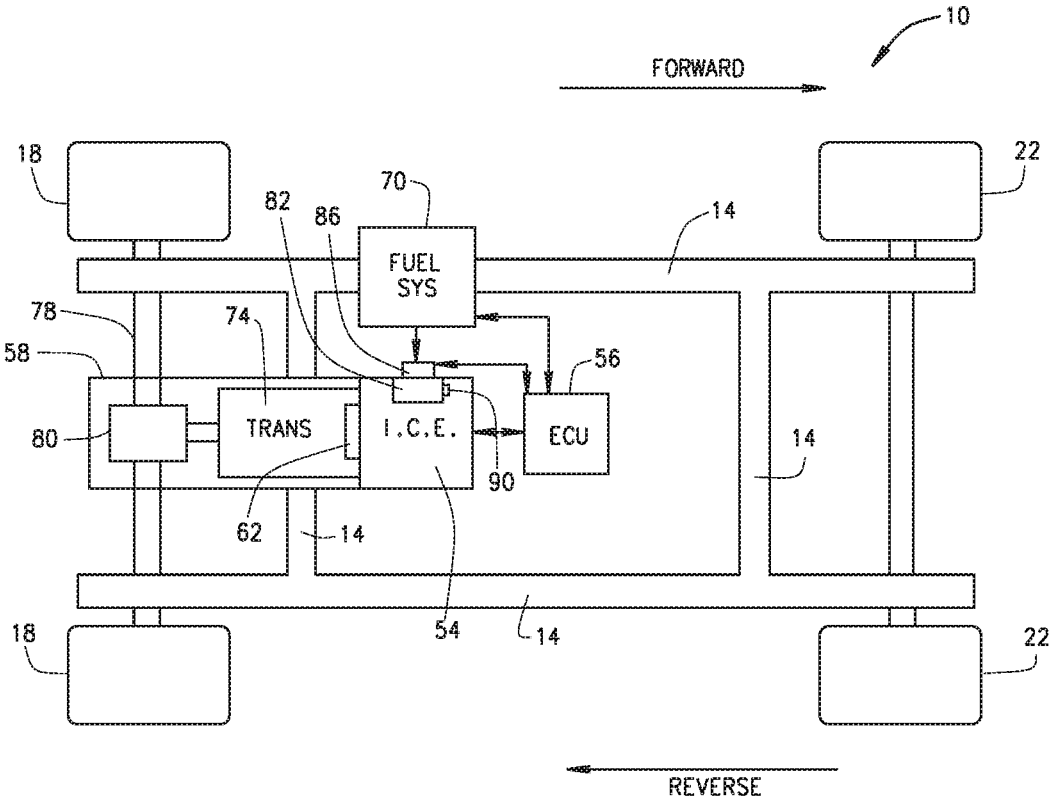
FIG. 2 is an exemplary illustration of a functional block diagram of the vehicle shown in FIG. 1, in accordance with various embodiments of the present disclosure.

Referring to FIGS. 1 and 2, in various embodiments, the present disclosure provides a gas powered utility vehicle 10 that is structured and operable to, under certain conditions, limit or restrict engine powered movement of the vehicle 10 prior to the vehicle engine reaching a predetermined temperature, thereby improving engine function and increasing fuel efficiency. The utility vehicle 10 can be generally any lightweight vehicle or low speed vehicle that is not designated for use on roadways such as a maintenance vehicle, a cargo vehicle, a shuttle vehicle, a golf car, an all-terrain vehicle (ATV), a utility-terrain vehicle (UTV), a worksite vehicle, a buggy, etc. However, for simplicity the vehicle 10 will be exemplarily illustrated and described herein with regard to a golf car.

The vehicle 10 generally comprises a chassis or frame 14, a pair of rear wheels 18 and a pair of front wheels 22 operationally connected to the chassis 14, and a passenger compartment 26. As used herein, the word "wheel(s)" will be understood to mean the structure consisting of the respective tire mounted on the respective wheel, also known as the rim, particularly, the compilation of the tire and wheel/rim. The passenger compartment 26 generally includes a dash console 30, a floorboard 34, and a passenger seating structure 38 structured and operable to provide seating for one or more occupants (e.g., a driver and one or more passengers). The dash console 30 can include one or more instrument displays, gauges, vehicle control devices and/or storage compartments. The vehicle 10 additionally includes a steering wheel 42 for use by the operator to control the directional movement of the vehicle 10, a brake pedal 46 for use by the operator to control slowing and stopping of the vehicle 10, and an accelerator pedal 50 for use by the operator to start and control the torque delivered by an internal combustion engine (ICE) 54 to one or more of the rear and/or front wheels 18 and/or 22. The ICE 54 is structured and operable to generate and deliver motive force to the vehicle 10.

More particularly, the ICE 54 is operatively connected to a drivetrain 58 that is operatively connected to at least one of the rear and/or front wheels 18 and/or 22. In various instances, the drivetrain 58 can comprise a transmission 74 (e.g., a continuously variable transmission (CVT)) that is operably connected to a rear axle 78 via a torque transfer device 80 (e.g., a differential). Operation of the ICE 54 is controlled by a computer-based engine control unit (ECU) 56 to generate torque (e.g., motive force, e.g., power) utilized to provide motive force for the vehicle 10 via the drivetrain 58. Although the drivetrain 58 of the present disclosure will, by way of example, be shown and described herein as structured and operable to deliver motive force to the rear wheel(s) 18, it should be understood that, in various embodiments, the drivetrain 58 can be structured and operable to deliver motive force to the front wheel(s) 22 and remain within the scope of the present disclosure. In yet other embodiments, it is envisioned that drivetrain 58 can be implemented in a four-wheel drive configuration including a power take off assembly (not shown, but readily understood by one skilled in the art) operable to deliver motive force (i.e., power/torque) generated by the prime mover 54 to one or more of the front wheel(s) 22 and/or rear wheel(s) 18.

The vehicle 10 further includes a fuel system 70, an engine throttle 82, and a throttle controller 86 that is communicatively connected to the ECU 56. The throttle controller 86 is operationally and/or communicatively connected to the accelerator pedal 50 and controls operation of the engine throttle 82. The fuel system 70 provides fuel to the throttle 82 whereby the throttle controller 86 controls the throttle 82 to control the fuel/air mixture supplied to the ICE 54 to increase and decrease the RPM of the ICE 54. Generally, as controlled by the throttle controller 86, the engine throttle 82 is responsive to positioning of the accelerator pedal 50 (controlled by a vehicle operator) to increase and decrease the RPM of the ICE 54 as desired, and thereby control the torque delivered by the ICE 54 to one or more of the front and/or rear wheels 22 and/or 18. Moreover, the ECU 56 is communicatively connected to the ICE 54, the throttle controller 86 and the fuel system 70 such that, via execution of one or more engine control or management logic, algorithm or program, the ECU 56 controls operation of the ICE 54 by controlling various ICE systems and parameters such as the fuel supplied by the fuel system 70, the fuel/air mixture provided by the throttle 82, and/or ignition timing of the ICE 54.

Figure 3:
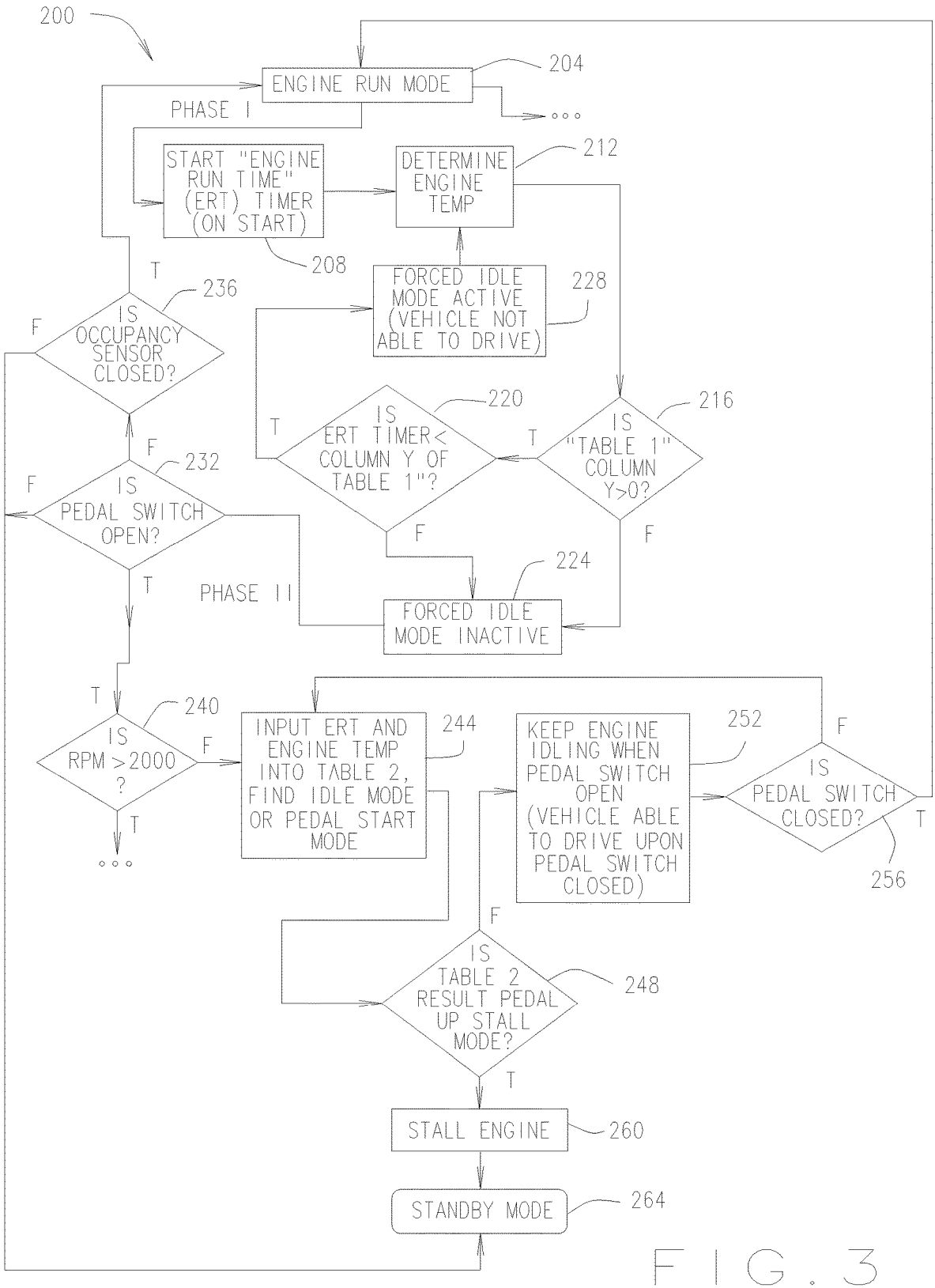
FIG. 3 is an exemplary flow chart of an internal combustion engine (ICE) management algorithm executed by a controller of the vehicle to control the delivery of torque from the ICE to the wheels of the vehicle, in accordance with various embodiments of the present disclosure.

FIG. 3 provides an exemplary flow chart 200 of an ICE management logic or algorithm executed by the ECU 56 to control the RPM of the ICE 54 and thereby control delivery of torque from the ICE 54 to the wheels 18/22, via the drivetrain 58. More particularly, ICE management algorithm is executable by the ECU 56 to limit or restrict engine powered movement of the vehicle 10 prior to the ICE 54 reaching a predetermined operating temperature. In various embodiment, execution of the ICE management algorithm generally determines an ICE temperature of the ICE 54 upon starting the ICE 54. Then, if the ICE temperature is below a predetermined ICE temperature threshold value, the ICE management algorithm controls operation of the ICE 54 such that the RPM of the ICE 54 remains within a predetermined idle RPM range (e.g., 1500 to 2000 RPM) for a predetermined amount of time, regardless of throttle control commands from the accelerator pedal 50. However, if the ICE temperature is equal to or greater than the predetermined ICE temperature threshold value, the ICE management algorithm controls operation of the ICE 54 in accordance with the throttle control commands from the accelerator pedal 50.

In various embodiments, the drivetrain 58 comprises a drivetrain clutch 62 that is connected to an ICE output shaft (not shown but readily understood by one skilled in the art) and is structured and operable to engage the ICE 54 with the drivetrain 58 when the ICE 54 (i.e., the ICE output shaft and clutch) rotates above a certain predetermined RPM (e.g., greater than 2000 RPM) and disengage the ICE 54 from the drivetrain 58 when rotated below the predetermined RPM (e.g., lower than 2000 RPM). Hence, the delivery and removal of torque (or motive power) to and from the drivetrain 58 and wheels 18/22 is controlled by engagement and disengagement of the drivetrain clutch 62, which is controlled by RPM of the ICE 54, which is controlled by the ECU 56. Generally, the vehicle operator can send acceleration signals or commands to the throttle controller 86 by operating the accelerator pedal 50, however, via execution of the ICE management algorithm, the ECU 56 can override or control the acceleration signals and control operation of the fuel system 70, the throttle controller 86 and the ICE ignition timing to control operation (i.e., control the RPM) of the ICE 54. More particularly, execution of the ICE management algorithm controls engagement and disengagement of the drivetrain clutch 62 to limit or restrict engine powered movement of the vehicle 10 prior to the ICE 54 reaching a predetermined operating temperature, thereby reducing fouling the ICE spark plugs and conserving fuel.

When a vehicle operator activates a vehicle On/Off switch to initiate operation of the vehicle 10, electrical power is provided to various electrical systems of the vehicle 10, including the ECU 56, whereby the vehicle is placed in a Standby Mode ready for operation. Thereafter, if the operator depresses the accelerator pedal 50 the ICE management algorithm enters a first phase (e.g., Phase I) of an Engine Run Mode, the ICE 56 begins operating at a predetermined idle RPM range (e.g., 1500 to 2000 RPM), and execution of the ICE management algorithm begins, as indicated a 204 of flow chart 200. Although the following steps, decisions and operations will sometimes be described herein as being carried out by the ECU 56 or carried out by the ICE management algorithm, it will be readily understood by one skilled in the art that the following steps, decisions and operations are more specifically accomplished via execution of the ICE management algorithm by the ECU 56 and/or one or more other controller of the vehicle 10. Simultaneously with the ICE 56 starting, an Engine Run Time (ERT) timer is started and an engine temperature is determined, as indicated a 208 and 212. The ERT timer monitors or tracks the cumulative amount of time the ICE 54 has operated from the time the On/Off switch and/or an accelerator pedal switch 94 is activated to begin operation of the vehicle 10, to the time the On/Off switch and/or pedal switch 94 is deactivated to cease operation of the vehicle 10. The ICE temperature can be determined utilizing any suitable sensor or means for determining the present temperature of the ICE 56. For example, in various instances the ICE temperature can be determined via a cylinder head temperature sensor that is operable to measure the temperature within a cylinder head of the ICE 56. Alternatively, in various instances, the ICE temperature can be determined via an engine coolant temperature sensor, or an engine oil temperature sensor, or any other suitable engine temperature sensor.

As indicated at 216 and 220, once the ICE temperature is determined, the ICE management algorithm accesses a "Temperature vs Forced Idle Time" lookup table or set of tables, such as that exemplarily illustrated in FIG. 4, where based on the ICE temperature, it is determined whether a Forced Idle Mode (described below) will be implemented by the ICE management algorithm. More particularly, at 216 it is determined whether, based on the ICE temperature, a forced idle time value of the lookup table is greater than a predetermined forced idle time threshold value (e.g., whether the forced idle time value is greater than zero). Alternatively, at 216 it can be determined whether the ICE temperature is greater than a predetermined temperature threshold (e.g., whether the ICE temperature is greater 0° C.). If the forced idle time value is not greater than the predetermined forced idle time threshold (or the ICE temperature is greater than the predetermined temperature threshold) the ICE management algorithm will not enter the forced idle mode and the ICE management algorithm will advance to a second phase (e.g., Phase II) of the ICE management algorithm as indicated at 224.

However, if the forced idle time value is greater than the predetermined forced idle time threshold (or the ICE temperature is less than the predetermined temperature threshold), as indicated at 220, the ICE management algorithm will determine whether the ERT is greater than or less than a predetermined ERT threshold value. For example, in various embodiments, the ICE management algorithm will determine whether the ERT is greater or less than the forced idle time that is determined by the ICE temperature and Table 1. If the ERT is less the forced idle time (e.g., less than the ERT threshold value), the ICE management algorithm will enter the Forced idle Mode, as indicated at 228, wherein the ICE management algorithm maintains operation of the ICE 54 within the predetermined idle RPM range, and for a selected forced idle time, regardless of the position of the accelerator pedal 50 or the position of a throttle position sensor (TPS) 90 (shown in FIG. 2) operatively connected to the throttle 82. More specifically, the RPM of ICE 54 will be maintained with idle RPM range, and therefore the drivetrain clutch 62 will not be allowed to engage, for a certain forced idle time selected from a table or database, for example Table 1 shown in FIG. 4, based on the ICE temperature determined at 212. For example, utilizing exemplary Table 1, if the ICE temperature determined at 212 is −10° C. the ICE management algorithm will maintain the ICE 54 RPM within the idle RPM range for the forced idle time 5 seconds regardless of the position of the accelerator pedal 50 or the position of the throttle position sensor (TPS) 90 operatively connected to the throttle 82. Or, if the ICE temperature determined at 212 is −30° C. the ICE management algorithm will maintain the ICE 54 RPM within the idle RPM range for the forced idle time of 15 seconds regardless of the position of the accelerator pedal 50 or the position of the throttle position sensor (TPS) 90 operatively connected to the throttle 82. Therefore, the ICE 54 RPM will be maintained within the idle RPM range for the amount of forced idle time indicated by Table 1 regardless of any attempt by a vehicle operator to command ICE propelled movement of the vehicle 10. After the forced idle time has elapsed the ICE management algorithm again determines the temperature of the ICE 54, as indicated 212, and re-execute the loop 212, 216, 220 and 228, as described above, until at 216 it is determined that the forced idle time value is not greater than the predetermined forced idle time threshold (or the ICE temperature is greater than the predetermined temperature threshold), whereafter the ICE management algorithm advances to the second phase (e.g., Phase II) of the ICE management algorithm as indicated at 224.

However, if at 220 it is determined that the ERT is greater than the forced idle time (e.g., greater than the ERT threshold value), the ICE management algorithm will not enter the forced idle mode and the ICE management algorithm will advance to the second phase (e.g., Phase II) of the ICE management algorithm as indicated at 224.

Upon advancing to Phase II, the ICE management algorithm will check the status of the accelerator pedal switch 94 (shown in FIG. 1) to determine whether the accelerator pedal 50 is depressed to induce ICE 54 powered movement of the vehicle 10 (e.g., the accelerator pedal switch 94 is closed), or the accelerator pedal 50 is not depressed (e.g., the accelerator pedal switch 94 is open), as indicated at 232. Generally, upon advancing to Phase II, the ICE management algorithm will determine whether or not the accelerator pedal 50 is depressed. If the throttle control commands indicate that the accelerator pedal is not depressed, the ICE management algorithm will determine the present ERT, and determine the present ICE temperature (e.g., an ICE temperature subsequent to the ICE temperature determined at 212). Thereafter, based on the ERT value and the subsequent ICE temperature value, the ICE management algorithm will either: 1) control operation of the internal combustion engine such that an RPM of the internal combustion engine remains within the predetermined idle RPM range for a predetermined amount of time or until the throttle control commands from an accelerator pedal 50 indicate that the accelerator pedal is depressed, or 2) based on the ERT value and the subsequent ICE temperature value, stall the ICE 54.

More specifically, in various embodiments, if the accelerator pedal switch 94 is opened, the ICE management algorithm places the ICE 54 and vehicle 10 in a Standby Mode, wherein the ICE 54 and vehicle 10 are enabled to respond to vehicle operator commands to induce and control ICE 54 powered movement of the vehicle 10 via operation and control of the accelerator pedal 50, as indicated at 264. In various other embodiments, the vehicle 10 can comprise one or more occupancy sensor(s) 98 (shown in FIG. 1) that are structured and operable to sense whether a vehicle operator is seated in the seating structure 38. In such embodiments, if at 232 the accelerator pedal switch 94 is determined to be closed, indicating the accelerator pedal 50 is depressed, the ICE management algorithm communicates with the occupancy sensor(s) 98 to determine whether a vehicle operator is seated in the seating structure 38 (e.g., the occupancy sensor 98 is closed), or the seating structure 38 is unoccupied (e.g., the occupancy sensor 98 is open), as indicated at 236. If it is determined that the seating structure 38 is unoccupied (e.g., the occupancy sensor 98 is open), the ICE management algorithm places the ICE 54 and vehicle 10 in a Standby Mode, wherein the ICE 54 and vehicle 10 are enabled to respond to vehicle operator commands to induce and control ICE 54 powered movement of the vehicle 10 via operation and control of the accelerator pedal 50, as indicated at 264. However, if it is determined that the seating structure is occupied (e.g., the occupancy sensor 98 is closed), the ICE management algorithm returns to the Engine Run Mode Phase I, as indicated at 204.

Alternatively, upon advancing to Phase II, if the ICE management algorithm determines at 232 that the accelerator pedal switch 94 is open, indicating the accelerator pedal 50 is not depressed, the ICE management algorithm measures the RPM of the ICE 54 to determine if RPM are greater than or less than the maximum value of the idle RPM range (e.g., greater than 2000 RPM), as indicated at 240. If at 240 it is determined that the ICE 54 RPM is greater than the maximum value of the idle RPM range (e.g., greater than 2000 RPM), the ICE management algorithm ceases and other vehicle 10 and/or ICE 54 control algorithms are initiated. However, if at 240 it is determined that the ICE 54 RPM is less than the maximum value of the idle RPM range (e.g., less than 2000 RPM) the ICE management algorithm continues to operate the ICE 54 within the idle RPM range and measures the present temperature of the ICE 54 and determines the present cumulative run time ERT of the ICE 54 (i.e., the cumulative time the ICE 54 has run from the time the On/Off switch and/or pedal switch 94 is activated to the time the ICE management algorithm executes 240). The ICE management algorithm then enters the present ICE 54 temperature and present ERT into a "Engine Temperature vs Engine Run Time" table (e.g., an associative data array or map) or set of tables, such as that exemplarily illustrated in FIG. 5, to determine whether to enter a Pedal Up Idle Mode or a Pedal Up Stall Mode, as indicated at 244 and 248.

As indicated at 252, when in the Pedal Up Idle Mode with the accelerator pedal 50 not depressed (as determined at 232), the ICE management algorithm will continue to operate the ICE 54 within the idle RPM range to allow the ICE 54 to continue to warm up (e.g., allow the ICE 54 temperature to continue to increase). Subsequently, as indicated at 256, the ICE management algorithm will again check the status of the accelerator pedal switch 94. If it is determined that the accelerator pedal switch 94 is closed (indicating that the accelerator pedal 50 is depressed), the ICE management algorithm will return to the Engine Run Mode Phase I, as indicated at 204. However, if it is determined that accelerator pedal switch 94 is open (indicated the accelerator pedal 50 is not depressed) the ICE management algorithm will loop back to 244 to determine the present ICE 54 temperature and the present ERT and continue to 248 as described above. The ICE management algorithm will continue in this loop and in the Pedal Up Idle Mode (e.g., continue to operate the ICE 54 within the idle RPM range) until the ICE 54 temperature and ERT, when entered into the "Engine temperature vs Engine Run Time" table, dictate that a Pedal Up Stall Mode should be initiate, as indicated at 260. When in the Pedal Up Stall Mode with the accelerator pedal 50 not depressed as determined at 232) the ICE management algorithm will stall the ICE 54 and enter the Standby Mode wherein the ICE 54 and vehicle 10 are enabled to respond to vehicle operator commands to induce and control ICE 54 powered movement of the vehicle 10 via operation and control of the accelerator pedal 50, as indicated at 264.

It is envisioned that the ECU 56 can be a hardware based module that is structured and operable to implement the ICE management algorithm functionality as described herein. For example, it is envisioned that the ECU 56 can comprise one or more, or be part of, application specific integrated circuit(s) (e.g., ASIC(s)), combinational logic circuit(s); field programmable gate array(s) (FPGA); processor(s) (shared, dedicated, or group) that execute software code; and/or other suitable hardware components that provide the functionality described herein; or a combination of some or all of the above, such as in a system-on-chip, and remain within the scope of the present disclosure.

Furthermore, it should be understood that, although the various ICE management operations and functionality are often described herein as being implemented or carried out by ECU 56 it will be appreciated that in some embodiments the ECU 56 may indirectly perform and/or control performance of such operations and functionality by generating commands and control signals that can cause other elements to carry out the control operations and functionality described herein. For example, in the ICE management algorithm implemented function described herein, it is the execution of the ICE management algorithm by one or more processors of the ECU 56 (and/or one or more other vehicle controllers) that can generate the ICE management commands that are then output by the ECU 56 to control the ICE management operations and functions described herein. Or, in the various hardware embodiments, it is the operation of the various ECU 56 hardware components that can generate the ICE management commands that are then output by the ECU 56 to control the ICE management operations and functions described herein. Additionally, although the ICE management algorithm as be described herein as being executed by the ECU 56, it is envisioned that the ICE management algorithm can be executed the ECU 56 and/or any other one or more controller(s) of the vehicle 10, and remain within the scope of the present disclosure.

The description herein is merely exemplary in nature and, thus, variations that do not depart from the gist of that which is described are intended to be within the scope of the teachings. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the disclosure. Such variations and alternative combinations of elements and/or functions are not to be regarded as a departure from the spirit and scope of the teachings.

What is claimed is:

1. A method for cold engine starting in a throttle-start vehicle, said method comprising:

determining an ICE temperature value of an internal combustion engine of a throttle-start vehicle upon starting the internal combustion engine via depression of an accelerator pedal of the vehicle;

comparing the ICE temperature value to a predetermined ICE temperature threshold value; and one of:

when the ICE temperature value is below a predetermined ICE threshold value, controlling operation of the internal combustion engine such that an RPM of the internal combustion engine remains within a predetermined idle RPM range for a predetermined amount of time, regardless of throttle control commands from the accelerator pedal of the vehicle; and when the ICE temperature value is equal to or greater than the predetermined ICE threshold value, controlling operation of the internal combustion engine in accordance with the throttle control commands from the accelerator pedal.

2. The method of claim 1 further comprises, prior to controlling operation of the internal combustion engine such that an RPM of the internal combustion engine remains within the predetermined idle RPM range:

determining an engine run time (ERT) indicating the amount of time internal combustion engine has been operating since the starting of the internal combustion engine;

comparing the ERT to a predetermined ERT threshold value; and one of:

when the ERT value is equal to or greater than the predetermined ERT threshold value, controlling operation of the internal combustion engine in accordance with the throttle control commands from the accelerator pedal when the ERT is below a predetermined ERT threshold value, controlling operation of the internal combustion engine such that an RPM of the internal combustion engine remains within a predetermined idle RPM range for a predetermined amount of time, regardless of the throttle control commands from the accelerator pedal of the vehicle.

3. The method of claim 2, wherein comparing the ICE temperature to a predetermined ICE temperature threshold value and comparing the ERT a predetermined ERT threshold value comprises utilizing a lookup table that comprises the ICE temperature threshold value and the ERT threshold value.

4. The method of claim 1, wherein controlling operation of the internal combustion engine in accordance with the throttle control commands from the accelerator pedal comprises:

when the throttle control commands indicate that the accelerator pedal is not depressed, determining an engine run time (ERT) indicating the amount of time internal combustion engine has been operating since the starting of the internal combustion engine;

determining a subsequent ICE temperature value of the internal combustion engine; and one of:

based on the engine run time value and the subsequent ICE temperature value, controlling operation of the internal combustion engine such that an RPM of the internal combustion engine remains within the predetermined idle RPM range for one of a predetermined amount of time or until the throttle control commands from an accelerator pedal indicate that the accelerator pedal is depressed; and based on the engine run time value and the subsequent ICE temperature value, stalling the internal combustion engine.

5. The method of claim 4, wherein controlling operation of the internal combustion engine such that an RPM of the internal combustion engine remains within the predetermined idle RPM range and stalling the internal combustion engine comprise utilizing an associative data array.

6. A throttle-start vehicle, said vehicle comprising:

an internal combustion engine structured and operable to generate and deliver motive force to the vehicle;

a throttle structured and operable to deliver fuel to internal combustion engine;

a throttle controller structured and operable to control the throttle;

an accelerator pedal connected to the throttle controller and structured and operable to start the internal combustion engine and send throttle control commands to the throttle controller; and an engine controller connected to at least one of the throttle controller and the internal combustion engine, and structured and operable to control operation of internal combustion engine, wherein to control the operation of the internal combustion engine the engine controller is structure and operable to:

determine an ICE temperature value of the internal combustion engine upon starting the internal combustion engine via depression of the accelerator pedal;

compare the ICE temperature value to a predetermined ICE temperature threshold value; and one of:

when the ICE temperature value is below a predetermined ICE threshold value, control operation of the internal combustion engine such that an RPM of the internal combustion engine remains within a predetermined idle RPM range for a predetermined amount of time, regardless of the throttle control commands from the accelerator pedal; and when the ICE temperature value is equal to or greater than the predetermined ICE threshold value, controlling operation of the internal combustion engine in accordance with the throttle control commands from the accelerator pedal.

7. The vehicle of claim 6, wherein the engine controller is further structured and operable to, prior to controlling operation of the internal combustion engine such that an RPM of the internal combustion engine remains within the predetermined idle RPM range:

determine an engine run time (ERT) indicating the amount of time internal combustion engine has been operating since the starting of the internal combustion engine;

compare the ERT to a predetermined ERT threshold value; and one of:

when the ERT value is equal to or greater than the predetermined ERT threshold value, control operation of the internal combustion engine in accordance with the throttle control commands from the accelerator pedal when the ERT is below a predetermined ERT threshold value, control operation of the internal combustion engine such that an RPM of the internal combustion engine remains within a predetermined idle RPM range for a predetermined amount of time, regardless of the throttle control commands from the accelerator pedal of the vehicle.

8. The vehicle of claim 7, wherein the engine controller is further structured and operable to utilize a lookup table that comprises the ICE temperature threshold value and the ERT threshold value when comparing the ICE temperature to a predetermined ICE temperature threshold value and comparing the ERT a predetermined ERT threshold value.

9. The vehicle of claim 6, wherein when controlling operation of the internal combustion engine in accordance with the throttle control commands from the accelerator pedal the engine controller is further structured and operable to:

determine when the throttle control commands indicate that the accelerator pedal is not depressed, and when the accelerator pedal is determined to not be depressed:

determine an engine run time (ERT) indicating the amount of time internal combustion engine has been operating since the starting of the internal combustion engine;

determine a subsequent ICE temperature value of the internal combustion engine; and one of:

based on the engine run time value and the subsequent ICE temperature value, control operation of the internal combustion engine such that an RPM of the internal combustion engine remains within the predetermined idle RPM range for one of a predetermined amount of time or until the throttle control commands from an accelerator pedal indicate that the accelerator pedal is depressed; and based on the engine run time value and the subsequent ICE temperature value, stall the internal combustion engine.

10. The vehicle of claim 9, wherein the engine controller is further structure and operable to utilize an associative data array when controlling operation of the internal combustion engine such that an RPM of the internal combustion engine remains within the predetermined idle RPM range and stalling the internal combustion engine comprise utilizing an associative data array.

11. A throttle-start vehicle, said vehicle comprising:

an internal combustion engine structured and operable to generate and deliver motive force to the vehicle;

a throttle structured and operable to deliver fuel to internal combustion engine;

a throttle controller structured and operable to control the throttle;

an accelerator pedal connected to the throttle controller and structured and operable to start the internal combustion engine and send throttle control commands to the throttle controller; and an engine controller connected to at least one of the throttle controller and the internal combustion engine, and structured and operable to control operation of internal combustion engine, wherein to control the operation of the internal combustion engine the engine controller is structure and operable to:

determine an ICE temperature value of the internal combustion engine upon starting the internal combustion engine via depression of the accelerator pedal;

compare the ICE temperature value to a predetermined ICE temperature threshold value; and one of:

when the ICE temperature value is below a predetermined ICE threshold value, control operation of the internal combustion engine such that an RPM of the internal combustion engine remains within a predetermined idle RPM range for a predetermined amount of time, regardless of the throttle control commands from the accelerator pedal; and when the ICE temperature value is equal to or greater than the predetermined ICE threshold value, controlling operation of the internal combustion engine in accordance with the throttle control commands from the accelerator pedal, wherein to control the operation of the internal combustion engine in accordance with the throttle control commands from the accelerator pedal, the engine controller is further structured and operable to determine when the throttle control commands indicate that the accelerator pedal is not depressed, and when the accelerator pedal is determined to not be depressed:

determine an engine run time (ERT) indicating the amount of time internal combustion engine has been operating since the starting of the internal combustion engine;

determine a subsequent ICE temperature value of the internal combustion engine; and one of:

based on the engine run time value and the subsequent ICE temperature value, control operation of the internal combustion engine such that an RPM of the internal combustion engine remains within the predetermined idle RPM range for one of a predetermined amount of time or until the throttle control commands from an accelerator pedal indicate that the accelerator pedal is depressed; and based on the engine run time value and the subsequent ICE temperature value, stall the internal combustion engine.

12. The vehicle of claim 11, wherein the engine controller is further structured and operable to, prior to controlling operation of the internal combustion engine such that an RPM of the internal combustion engine remains within the predetermined idle RPM range:

determine an engine run time (ERT) indicating the amount of time internal combustion engine has been operating since the starting of the internal combustion engine;

compare the ERT to a predetermined ERT threshold value; and one of:

when the ERT value is equal to or greater than the predetermined ERT threshold value, control operation of the internal combustion engine in accordance with the throttle control commands from the accelerator pedal when the ERT is below a predetermined ERT threshold value, control operation of the internal combustion engine such that an RPM of the internal combustion engine remains within a predetermined idle RPM range for a predetermined amount of time, regardless of the throttle control commands from the accelerator pedal of the vehicle.

13. The vehicle of claim 12, wherein the engine controller is further structured and operable to utilize a lookup table that comprises the ICE temperature threshold value and the ERT threshold value when comparing the ICE temperature to a predetermined ICE temperature threshold value and comparing the ERT a predetermined ERT threshold value.

14. The vehicle of claim 12, wherein the engine controller is further structure and operable to utilize an associative data array when controlling operation of the internal combustion engine such that an RPM of the internal combustion engine remains within the predetermined idle RPM range and stalling the internal combustion engine comprise utilizing an associative data array.

* * * * *